US006102083A

United States Patent [19]

Vandoorne

[11] Patent Number: 6,102,083

[45] Date of Patent: Aug. 15, 2000

[54] METHOD FOR WEAVING A PILE FABRIC, WITH APPLICATION OF WEAVE CORRECTIONS

[75] Inventor: Nico Vandoorne, Rekkem, Belgium

[73] Assignee: N.V. Michel Van de Wiele, Kortrijk/Marke, Belgium

[21] Appl. No.: 09/220,707

[22] Filed: Dec. 24, 1998

[30] Foreign Application Priority Data

Dec. 29, 1997 [BE] Belgium ..... 09701057

[51] Int. Cl.[7] ..... D03D 27/00

[52] U.S. Cl. ..... 139/391; 139/21; 139/398

[58] Field of Search ..... 139/11, 20, 21, 139/27, 37, 46, 116.5, 291 C, 391, 392, 394, 397, 398, 404, 405, 407, 408, 440, 411, 412; D03D 27/06, 27/10

[56] References Cited

U.S. PATENT DOCUMENTS

| | | | |
|---|---|---|---|
| 2,247,308 | 6/1941 | Redman | 28/1 |
| 3,013,325 | 12/1961 | McNally et al. | 28/72 |
| 3,327,738 | 6/1967 | Sabbe | 139/398 |
| 3,394,739 | 7/1968 | Crenshaw et al. | 139/21 |
| 4,456,035 | 6/1984 | Bruggemann et al. | 139/398 |
| 5,398,730 | 3/1995 | Derudder et al. . | |
| 5,400,831 | 3/1995 | Gheysen | 139/21 |
| 5,522,435 | 6/1996 | DeRudder | 139/65 |
| 5,655,573 | 8/1997 | Gheysen et al. | 139/21 |

FOREIGN PATENT DOCUMENTS

| | | |
|---|---|---|
| 0 460 756 | 12/1991 | European Pat. Off. . |
| 0 534 515 | 3/1993 | European Pat. Off. . |
| 0 767 261 | 4/1997 | European Pat. Off. . |
| 43 25 447 | 8/1994 | Germany . |

OTHER PUBLICATIONS

Ludo Smissaert, "Addendum Weave Catalogue 1994", Michel Van de Wiele, Belgium XP 002022163, Sep. 21, 1994.

*Primary Examiner*—John J. Calvert
*Assistant Examiner*—Robert H. Muromoto, Jr.
*Attorney, Agent, or Firm*—James Creighton Way; Meera P. Narasimhan

[57] ABSTRACT

A method for the face-to-face weaving of a pile fabric whereby on a weaving machine in successive insertion cycles in each case two weft threads (1), (2) are inserted almost simultaneously between binding warp threads and pile threads, so that two backing fabrics are woven, pile threads (3), (4), (5) have parts which form pile according to a two-shot weave and have other parts which are inwoven in a backing fabric, and two married pile threads (3), (4); (4), (5) perform a pile change. The successive positions (B=bottom; M=middle; T=top) of each pile thread (3), (4), (5) are predetermined in relation to the weft threads (1), (2) in a series of successive lift plans, of which every lift plan determines the positions in relation to the weft threads (1, 2) of two successive insertion cycles. According to this invention an effect that could be the result of a pile change is prevented by replacing the last lift plan of at least one of the pile threads (3), (4); (4), (5) which perform the pile change prior to the pile change and/or the first lift plan after the pile change by a correction lift plan.

8 Claims, 3 Drawing Sheets

METHOD FOR WEAVING A PILE FABRIC, WITH APPLICATION OF WEAVE CORRECTIONS

BACKGROUND OF THE INVENTION

This invention relates to a method for the face-to-face weaving of a pile fabric whereby on a weaving machine in successive insertion cycles in each case two weft threads are inserted almost simultaneously between binding warp threads and pile threads, so that two backing fabrics are woven, so that pile threads have parts which form pile according to a two-shot weave and have other parts which are inwoven in a backing fabric, and so that two pile threads perform a pile change, whereby the successive positions (B=bottom; M=middle; T=top) of each pile thread are predetermined in relation to the weft threads in a series of successive lift plans, of which every lift plan determines the positions in relation to the weft threads of two successive insertion cycles.

With such a generally known method for the face-to-face weaving of a pile fabric the binding warp threads are positioned by weaving frames and the pile threads are, by means of a jacquard machine, individually positioned in relation to the levels at which both weft threads will be simultaneously inserted.

The positioning of the binding warp threads occurs such that the binding warp threads weave in weft threads at two levels and form a top and a bottom backing fabric, whereby of the two weft threads inserted in one and the same insertion cycle in each case one is inwoven in the top backing fabric and one in the bottom backing fabric.

The positioning of the pile threads occurs such that pile threads with different visible properties (such as for example their color) form pile in different areas of the pile fabric corresponding to a predetermined pattern which is to be made visible in the pile fabric. The formation of pile occurs according to a two-shot weave whereby the pile-forming pile thread is alternately passed around a weft thread of one of the backing fabrics and around a weft thread (which was inserted during the following insertion cycle) of the other backing fabric. Non-pile-forming parts of the pile threads are inwoven divided up in the top and the bottom backing fabric. For each pile thread it is predetermined in which backing fabric the non-pile-forming parts have to be inwoven. If in two pile rows two pile threads differing in color form pile one after the other in warp direction then a pile change is performed between these two pile threads.

A pile change of a first and a second pile thread implies that the situation whereby the first pile thread forms pile while the second pile thread is inwoven in a backing fabric is reversed after a well-defined insertion cycle so that from the following insertion cycle the first pile thread is inwoven and the second pile thread forms pile.

It is further also generally known that the positions which every pile thread must occupy in relation to the successively inserted weft threads can be predetermined in a series of successive lift plans. Each lift plan determines the positions of a pile thread in relation to the two pairs of weft threads which have been inserted during two successive insertion cycles. A lift plan can be a graphic or a symbolic representation of a number (in this case two) of successive positions of a pile thread, whereby for every position (per shot) there are three different possibilities, namely top, middle and bottom. For each of these three possible choices a lift plan must therefore be able to give a different indication (symbol). Generally a lift plan is to be considered as a position instruction which determines the, positions for a pile thread in relation to the weft threads which have been inserted during a number (two) of successive insertion cycles. A lift plan is therefore derived from an elementary weave over a specific weft repeat. The positions of the pile threads are determined per two insertion cycles. In order to form a pile loop two insertion cycles must indeed also be performed. The state (pile-forming or inwoven) of a pile thread therefore in each case remains the same for at least two insertion cycles.

In this specification and in the claims a lift plan of a pile thread is indicated by means of two letters placed between square brackets which respectively indicate the successive positions (B=bottom; M=middle; T=top) of this pile thread in relation to the weft threads inserted one above the other during two successive insertion cycles.

The pile threads extending between the two backing fabrics are subsequently cut through so that two pile fabrics are obtained. Each pile fabric comprises a backing fabric with weft threads inwoven by binding warp threads and a large number of pile loops, with upright pile tufts, passed around weft threads.

It is also known that a number of pile changes of pile threads with different properties, such as for example a different color, cause effects which adversely affect the quality of the fabric. Thus there are pile changes which cause mixed contours and/or double-acting pile tufts.

The purpose of a pile change of two pile threads with different visible properties (such as e.g. color) is to obtain two areas in a pile fabric with a different appearance (color) corresponding to a predetermined pattern. Such a pile change results in mixed contours if a pile tuft of one of the pile, threads is in the area where the other pile thread forms pile. Because of this the dividing line between the two areas is disrupted and a pattern is obtained with blurred contours. Such mixed contours are especially disadvantageous if it concerns a pile change of two differently colored pile threads. The disrupted dividing line between neighboring color fields causes a blurry looking pile pattern, so that an inferior pile fabric is obtained.

If two pile tufts extend between the same weft threads of a backing fabric located one next to the other and are therefore not separated from each other by an intermediate weft thread this also results in a disruption of the appearance of the pile fabric. There are also a number of pile changes which cause such a fault, which are indicated as "double-acting pile tufts."

There are also pile changes which give the result that a pile thread when forming a first pile loop around a weft thread located along the back cannot be tightly stretched. This causes an imperfect design on the back of the pile fabric.

Mixed contours can be avoided by not allowing any pile threads to form pile during a pile change for two consecutive insertion cycles. In that manner a clear separation is obtained between two areas with a different appearance. A disadvantage of this is that a pile loop must be eliminated. This is not always possible. Furthermore this must always be taken into account when drafting the card design. This causes much additional work.

Another known method for avoiding mixed contours consists in determining the positions of the various pile threads in relation to the successive weft threads in a series of successive lift plans, of which every lift plan determines the positions in relation to the weft threads which have been inserted during three successive insertion cycles. A working repeat is thus obtained for the pile threads that runs over three insertion cycles, while the working repeat for the binding warp threads (for forming the backing fabrics) runs over two insertion cycles. If lift plans are initially provided for the pile threads which determine the positions in relation the weft threads of two consecutive insertion cycles, then this method implies that all lift plans of all pile threads must be changed.

A first purpose of this invention is to provide a method for the face-to-face weaving of a pile fabric according to which certain undesirable effects which are the result of a pile change can be avoided without having to take them in account when drafting the card design. A second purpose of the invention consist in avoiding these undesired affects without having to change all provided lift plans of all pile threads for that purpose.

These objectives are attained by providing a method with the characteristics mentioned in the first paragraph of this specification, whereby according to this invention an effect that could be the result of a pile change is prevented by replacing the last lift plan of at least one of the pile threads which perform the pile change prior to the pile change and/or the first lift plan after the pile change by a correction lift plan.

SUMMARY OF THE INVENTION

According to this method lift plans only have to be replaced prior to and after a pile change. The working repeat of the pile threads moreover remains unchanged (over two insertion cycles), so that all other lift plans can remain unchanged Furthermore need not be included in the card design.

In order effectively to avoid mixed contours and/or double-acting pile tufts the four replacements of lift plans described below are performed by correction lift plans (paragraphs A, B, C, D):

A. of the pile thread which has to form pile prior to the pile change and after the pile change has to be inwoven in the bottom backing fabric,
   - either the last lift plan [B, T] is replaced prior to the pile change by a correction lift plan [T, B],
   - or the first lift plan [M, B] is replaced after the pile change by a correction lift plan [B, M].

B. of the pile thread which has to form pile prior to the pile change and after the pile change has to be inwoven in the top backing fabric,
   - either the last lift plan [B, T] is replaced prior to the pile change by a correction lift plan [T, B],
   - or the first lift plan [T, M] is replaced after the pile change by a correction lift plan [M, T] or a correction lift plan [M, M].

C. of the pile thread which has to form pile after the pile change and prior to this pile change has to be inwoven in the bottom backing fabric,
   - either the last lift plan [M, B] is replaced prior to the pile change by a correction lift plan [B, M], or by a correction lift plan [M, M].
   - or the first lift plan [B, T] is replaced after the pile change by a correction lift plan [T, B].

D. of the pile thread which has to form pile after the pile change and prior to the pile change has to be inwoven in the top backing fabric,
   - either the last lift plan [T, M] is replaced prior to the pile change by a correction lift plan [M, T].
   - or the first lift plan [B, T] is replaced after the pile change by a correction lift plan [T, B], or by a correction lift plan [B, T].

Each of the replacements described in paragraphs A and B (of a lift plan of the pile thread which has to form pile prior to the pile change) can be combined with each of the replacements described in paragraphs C and D (of a lift plan of a pile thread which has to form pile after the pile change).

A number of preferred combinations of two of the above described replacements are the following:

If a first and a second pile thread have tc perform two pile changes one after the other according to a respective series of three successive lift plans, whereby the first pile thread has to form pile according to the first and the third lift plan of its series and has to be inwoven according to its second lift plan, and whereby the second pile thread has to form pile according to the second lift plan of its series, and has to be inwoven according to its first and its third lift plan,

- in the case that the first and the second pile thread have to be inwoven respectively in the bottom and the top backing fabric, the second lift plan [M, B] of the first pile thread is replaced by a correction lift plan [B, M] and the second lift plan [B, T] of the second pile thread (4) is replaced by a correction lift plan [T, B]
- in the case that the first and the second pile thread have to be inwoven respectively in the top and the bottom backing fabric, the second lift plan [T, M] of the first pile thread is replaced by a correction lift plan [M, T] and the second lift plan [B, T] of the second pile thread is replaced by a correction lift plan [T, B],
- in the case that the first and the second pile thread have to be inwoven in the bottom backing fabric, both the second lift plan [M, B] of the first pile thread and the first lift plan [M, B] of the second pile thread are replaced by a correction lift plan [B, M],
- and in the case that the first and the second pile thread have to be inwoven in the top backing fabric, both the second lift plan [T, M] of the first pile thread and the first lift plan [T, M] of the second pile thread are replaced by a correction lift plan [M, T].

If a first pile thread which has to form pile prior to a pile change has to be inwoven in the bottom backing fabric after the pile change, and if a second pile thread has to be inwoven in the top backing fabric prior to the pile change and has to form pile after the pile change according to at least two successive lift plans, the first lift plan [M, B] is replaced after the pile change of the first pile thread by a correction lift plan [B, M], and the first lift plan [B, T] is replaced after the pile change of the second pile thread by a correction lift plan [M, T].

If a first, a second and a third pile thread have to perform two pile changes one after the other according to a respective series of three successive lift plans, whereby the first pile thread has to form pile according to the first lift plan of its series and has to be inwoven according to its second and its third lift plan, whereby the second pile thread has to form pile according to the second lift plan of its series, and has to be inwoven according to its first and its third lift plan, and whereby the third pile thread has to form pile according to the third lift plan of its series, and has to be inwoven according to its first and its second lift plan,

- in the case that the first and the third pile thread have to be inwoven in the bottom backing fabric, and the second pile thread has to be inwoven in the top backing fabric, the second lift plan [M, B] of the first pile thread is replaced by a correction lift plan [B, M], the second lift plan [B, T] of the second pile thread (4) is replaced by a correction lift plan [T, B], and the second lift plan [M, B] of the third pile thread (5) is replaced by a correction lift plan [M, M]

in the case that the first pile thread has to be inwoven in the bottom backing fabric, and the second and the third pile thread have to be inwoven in the top backing fabric, the second lift plan [M, B] of the first pile thread is replaced by a correction lift plan [B, M], the second lift plan [B, T] of the second pile thread is replaced by a correction lift plan [T, B], and the third lift plan [B, T] of the third pile thread is replaced by a correction lift plan [T, B].

According to a method according to this invention, whereby yet other replacements of lift plans than the above mentioned are applied, of the pile thread which has to form pile prior to a pile change and has to be inwoven after the pile change, the last lift plan [B, T] prior to the pile change and the first lift plan [M, B] or [T, M] after the pile change are respectively replaced by the successive correction lift plans [B, M] and [M, T], and of the pile thread which has to be inwoven prior to the pile change and has to form pile after the pile change, the last lift plan [M, B] or [T, M] prior to the pile change and the first lift plan [B, T] after the pile change are respectively replaced by the successive correction lift plans [M, T] and [B, M].

By applying the method described in the preceding paragraph, if two married pile threads have to perform a pile change after every two successive insertion cycles according to a respective series of successive lift plans, all lift plans [B, T] of these series can be replaced by lift plans [B, M], and all lift plans [M, B] and [T, M] of these series can be replaced by lift plans [M, T].

According to this invention every replacement of a lift plan by a correction lift plan is preferably automatically performed by a device programmed for that purpose.

The aforementioned device can moreover also be provided in order automatically to detect the pile changes to be avoided on the basis of a card design of the pile fabric to be woven, by verifying the color transitions and their sequence.

The above described weave corrections and the undesired effects which are avoided because of them, are explained in the following specification with reference to the drawings attached hereto in which these corrections are indicated.

DETAILED DESCRIPTION

Figure 1A:
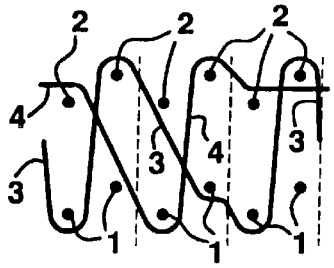
FIGS. 1A through 15B show, in a schematic cross-section of a part of a pile fabric, the course of a number of pile threads in relation to the pairs of weft threads (1, 2) which have been inserted during several insertion cycles with the performance of one or several pile changes.
Figure 1B:
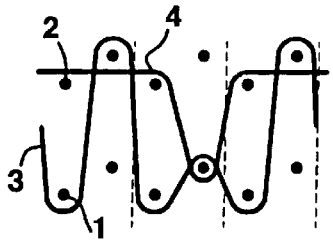
Figure 2A:
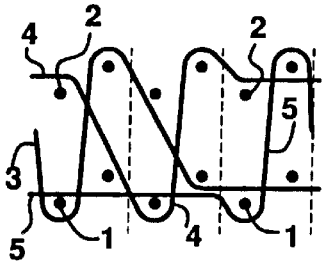
Figure 2B:
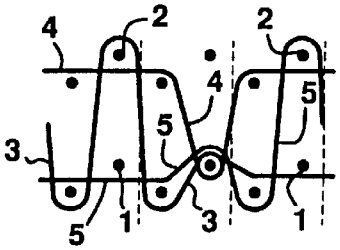
Figure 3A:
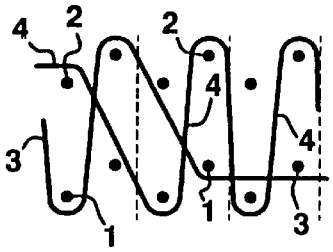
Figure 3B:
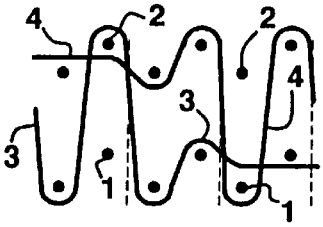

Each pair of FIGS. (1A, 1B), (2A, 2B), . . . , (14A, 14B), (15A, 15B) placed next to one another illustrates a number of weave corrections, whereby the left-hand FIG. 1A, 2A, 3A, . . . , 14A, 15A in each case shows the course of a number of pile threads prior to the implementation of the weave corrections, and the right-hand FIGS. 1B, 2B, 3B, . . . , 14B, 15B in each case shows the course of the same pile threads after the implementation of these weave corrections (the replacement of lift plans by correction lift plans).

With the face-to-face weaving of a pile fabric according to this invention in successive insertion cycles in each case a pair of weft threads (1), (2) are simultaneously inserted between binding warp threads (not represented in the figures) and pile threads (3), (4), (5). The binding warp threads are moreover so positioned that a top and a bottom backing fabric (1, 2) are formed, whereby of every pair of weft threads (1, 2) in each case one weft thread (2) is inwoven in the top backing fabric and one weft thread (1) in the bottom backing fabric.

The working repeat for the pile threads (3), (4), (5) runs over two insertion cycles. Every lift plan for a pile thread (3), (4), (5,) therefore determines the positions of this pile thread in relation to a first (1, 2) and a second pair of weft threads (1, 2) which have been inserted during successive insertion cycles. In the figures the weft threads located between two vertical dashed lines together form such a first and second pair of weft threads. The course of a pile thread (3), (4), (5) represented in the figures between two vertical dashed lines therefore corresponds with what is determined for a lift plan for this pile thread.

The positions of every pile thread (3), (4), (5) are determined by several successive lift plans. By way of example the number of pile threads represented is limited to two or three. In a fabric according to this invention a greater number of pile threads (e.g. 5, 6, 8 or even 20 pile threads) can however be provided. Every combination can however be reduced to one of the examples given.

The weft threads (1), (2) of a first pair are respectively inwoven along the back of the bottom backing fabric and along the pile side of the top backing fabric. The weft threads (1), (2) of the second pair are respectively inwoven along the pile side of the bottom fabric and along the back of the top backing fabric. This is achieved through the location of these weft threads in relation to a tension warp thread not represented in the figures.

In FIGS. 1A through 4B in each case the pile thread course is indicated according to three successive lift plans (or during three successive working repeats).

FIG. 1A illustrates the course of a first (3) and a second pile thread (4) during the performance of two pile changes according to three successive lift plans.

The lift plans of the first pile thread (3) are successively [B, T], [M, B], [B, T], and therefore determine that this pile thread (3) during the three working repeats in question successively has to form pile, has to be inwoven in the bottom backing fabric, and has again to form pile.

The successive lift plans of the second pile thread (4) are [T, M], [B, T] and [T, M], and therefore determine that this pile thread (4) during the three working repeats in question successively has to be inwoven in the top backing fabric, has to form pile, and has again to be inwoven in the top backing fabric.

As can clearly be seen in FIG. 1A there are double-acting pile tufts between the third and the fourth weft thread (1) of the bottom backing fabric (with reference to the figures the different weft threads (1), (2) are indicated by mention of their place and of the backing fabric to which they belong in the figure in question, whereby the first weft thread is always the left-most), and the part of the second pile thread (4) that is between the first (2) and the second weft thread (2) of the top backing fabric will form a pile tuft that is in an area where the first pile thread (3) forms pile and therefore cause a mixed contour.

The above mentioned adverse effects of the pile changes are remedied by replacing the second lift plan [M, B] of the first pile thread (3) by a correction lift plan [B, M], and by replacing the second lift plan [B, T] of the second pile thread (4) by a correction lift plan [T, B]. In FIG. 1B it can easily be seen that this correction results in both the double-acting pile tufts and the pile tuft that causes a mixed contour being prevented. By bringing the first pile thread (3) above the fourth weft thread (1) of the bottom backing fabric located along the pile side before it starts to form pile in the third working repeat this pile thread (3) is also better stretched and a more perfect design is obtained on the back of the pile fabric.

FIG. 2A illustrates the course of a first (3), a second (4) and a third pile thread (5) during the performance of two pile changes according to three successive lift plans.

The lift plans of the first pile thread (3) are successively [B, T], [M, B] and [M, B], and therefore determine that this pile thread (3) has to form pile during the first of the three working repeats in question, and has to be inwoven in the bottom backing fabric during the second and the third repeat.

The successive lift plans of the second pile thread (4) are [T, M], [B, T] and [T, M], and therefore determine that during the three working repeats in question, this pile thread (4) has successively to be inwoven in the top backing fabric, has to form pile, and has again to be inwoven in the top backing fabric.

The lift plans of the third pile thread (5) are successively [M, B], [M, B] and [B, T], and therefore determine that this pile thread (5) has to be inwoven in the bottom backing fabric during the first and the second of the three working repeats in question, and has to form pile during the third repeat.

As can clearly be seen in FIG. 2A this weave causes double-acting pile tufts and a mixed-contour-causing pile tuft in the same places as in FIG. 1A.

As can clearly be seen in FIG. 2B these adverse effects are avoided by replacing the second lift plan [M, B] of the first pile thread (3) by a correction lift plan [B, M] and replacing the second lift plan [B, T] of the second pile thread (4) by a correction lift plan [T, B,]. Furthermore the second lift plan [M, B] of the third pile thread (5) is replaced by a correction lift plan [M, M], through which the third pile thread (5) is brought above the fourth weft thread (1) of the bottom backing fabric located along the pile side before it starts to form pile in the third working repeat. This pile thread (5) is because of this better stretched so that a more perfect design is obtained on the back of the pile fabric.

FIG. 3A is different from FIG. 1A because of the fact that the situation after the first pile change continues to be maintained during the third working repeat. With the weave from FIG. 3A the same adverse effects are also obtained in the same places as in FIG. 1A. The part of the first pile thread (3) that is between the third (1) and the fourth weft thread (1) of the bottom backing fabric will now however also form a pile tuft that is in an area where the second pile thread (4) forms pile and therefore causes a mixed contour.

The second lift plan [M, B] of the first pile thread (3) is also replaced here by a correction lift plan [B, M] (see FIG. 3B). The second lift plan [B, T] of the second pile thread (4) is now however replaced by a correction lift plan [M, T]. The double-acting pile tufts and the mixed-contour-causing pile tufts are avoided because of this, while the second pile thread (4) under the third weft thread (2) of the top backing fabric located along the pile side is stretched before it starts to form pile in the third working repeat, so thatc ha more perfect design is obtained on the back of the pile fabric.

Figure 4A:
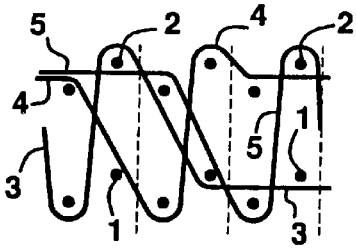
Figure 4B:
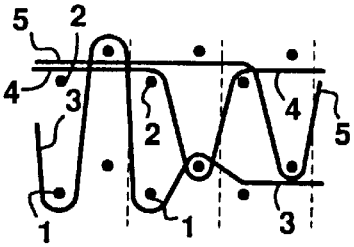

FIG. 4A is different from FIG. 2A because of the fact that the third weft thread (5) is inwoven in the top (and not in the bottom) backing fabric in its first and its second working repeat. With the weave from FIG. 4A the same adverse effects are also obtained in the same places as in FIG. 2A. In order to avoid these adverse effects for the first (3) and the second pile thread (5) the same lift plans are also replaced by the same correction lift plans as for the weave from FIG. 2A. Now however the third lift plan [B, T] of the third pile thread (5) is replaced by a correction lift plan [T, B]. The corrected weave (FIG. 4B) is free of adverse effects.

Figure 5A:
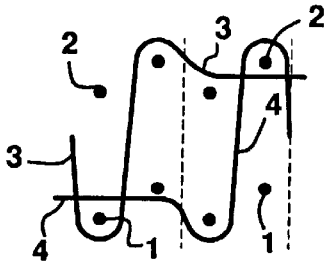
Figure 5B:
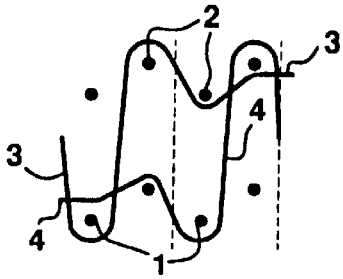

FIGS. 5A and 5B show the pile thread course with a pile change of a first pile thread (3) which forms pile prior to the pile change and is inwoven in the top backing fabric after the pile change, and a second pile thread (4) which is inwoven in the bottom backing fabric prior to the pile change and forms pile after the pile change. In order to obtain a more perfect design on the back of the pile fabrics the second lift plan [T, M] of the first pile thread (3) and the first lift plan [M, B] of the second pile thread (4) are replaced by a respective correction lift plan [M, M].

Figure 6A:
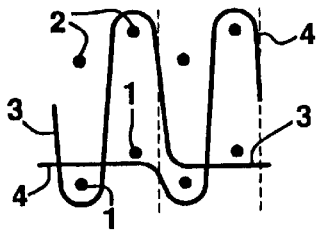
Figure 6B:
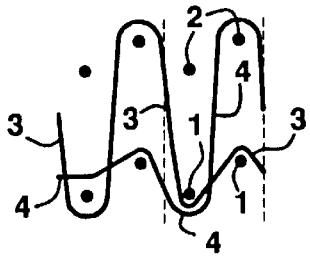

FIGS. 6A and 6B show the pile thread course with a pile change of a first pile thread (3) which forms pile prior to the pile change and is inwoven in the bottom backing fabric after the pile change, and a second pile thread (4) which is inwoven in the bottom backing fabric prior to the pile change and forms pile after the pile change.

In order to avoid a mixed contour between the third (1) and the fourth weft thread (1) of the bottom backing fabric the second lift plan [M, D] of the first pile thread (3) is replaced by a correction lift plan [B, M], and the first lift plan [M, B] of the second pile thread (4) is replaced by a correction lift plan [M, M].

Figure 7A:
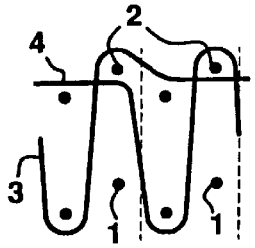
Figure 7B:
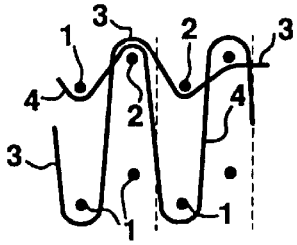

FIGS. 7A and 7B show the pile thread course with a pile change of a first pile thread (3) which forms pile prior to the pile change and is inwoven in the top backing fabric after the pile change, and a second pile thread (4) which is inwoven in the top backing fabric prior to the pile change and forms pile after the pile change.

In order to avoid a mixed contour between the first (2) and the second weft thread (2) of the top backing fabric the second lift plan [T, M] of the first pile thread (3) is replaced by a correction lift plan [M, M], and the first lift plan [T, M] of the second pile thread (4) is replaced by a correction lift plan [M, T].

FIGS. 8A through 15B show the pile thread course during four successive working repeats whereby respectively a first (3) and a second pile thread (4) alternately form pile.

Four possible situations are distinguished depending on the backing fabric in which the first and the second pile thread are inwoven when they do not form pile:

1. If the first pile thread (3) is inwoven in the bottom backing fabric and the second pile thread (4) is inwoven in the top backing fabric, these pile threads have the following successive lift plans:
   the first pile thread (3): [B, T], [M, B], [B, T], [M, B]
   the second pile thread (4): [T, M], [B, T], [T, M], [B, T]

Figure 8A:
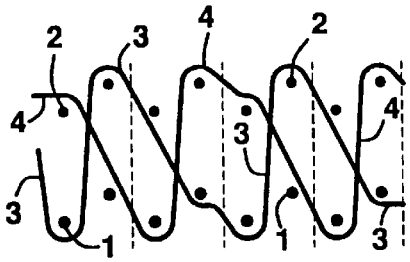
Figure 12A:
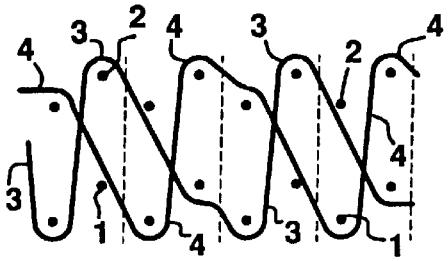

This situation is represented in FIGS. 8A and 12A. Double-acting pile tufts are obtained between the third (1) and the fourth weft thread (1) and between the seventh (1) and the eighth weft thread (1) of the bottom backing fabric. The parts of the first (3) and the second pile thread (4) which are between the first (2) and the second weft thread (2) and between the fifth (2) and the sixth weft thread (2) of the top backing fabric cause double-acting pile tufts, because these parts are separated from each other by an intermediate weft thread (2).

Figure 8B:
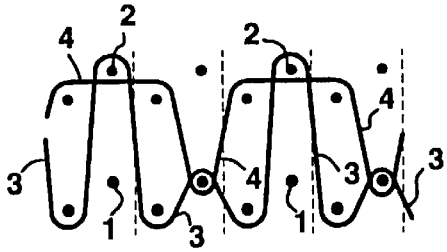
Figure 12B:
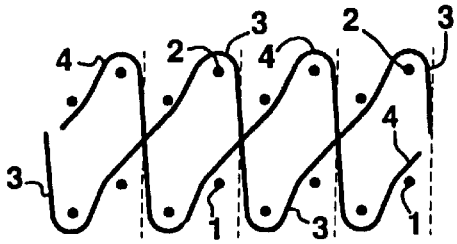

The adverse effects which could occur in this situation can be avoided in two different ways, respectively by a weave correction according to FIG. 8B and by a weave correction according to FIG. 12B.

With the weave correction according to FIG. 8B the second lift plan [M, B] and the fourth lift plan [M, B] of the first pile thread (3) are replaced by respective correction lift plans [B, M], and the second lift plan [B, T] and the fourth lift plan [B, T] of the second pile thread (4) are replaced by respective correction lift plans [T, B].

With the weave correction according to FIG. 12B the four successive lift plans [B, T], [M, B], [B, T], [M, B] of the first pile thread (3) are replaced by the following four successive lift plans: [B, M], [M, T], [B, M], [M, T], and the four successive lift plans [T, M], [B, T], [T, M], [B, T] of the second pile thread (4) are replaced by the following four successive lift plans; [M, T], [B, M], [M, T], [B, M].

2. If the first pile thread (3) is inwoven in the top backing fabric and the second pile thread (4) is inwoven in the bottom backing fabric, these pile threads have the following successive lift plans:
   the first pile thread (3): [B, T], [T, M], [B, T], [T, M]
   the second pile thread (4): [M, B], [B, T], [M, B], [B, T]

Figure 9A:
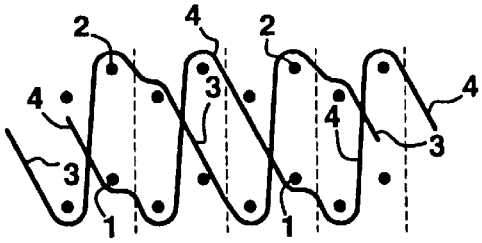
Figure 13A:
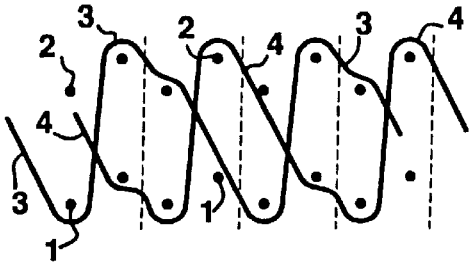

This situation is represented in FIGS. 9A and 13A. Double-acting pile tufts are obtained between the third (2) and the fourth weft thread (2) and between the seventh (2) and the eighth weft thread (2) of the top backing fabric. The parts of the first (3) and the second pile thread (4) which are between the first (1) and the second weft thread (4) and between the fifth (1) and the sixth weft thread (1) of the bottom backing fabric will also cause double-acting pile tufts.

Figure 9B:
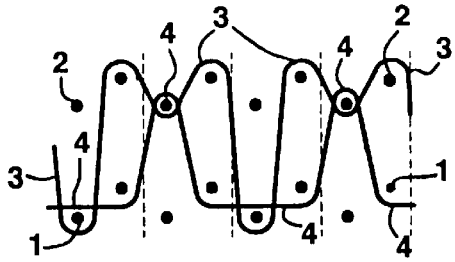
Figure 13B:
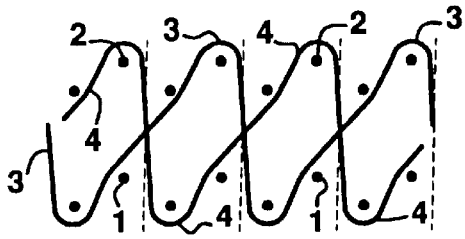

The adverse effects which could occur in this situation can be avoided in two different ways, respectively by a weave correction according to FIG. 9B and by a weave correction according to FIG. 13B.

With the weave correction according to FIG. 9B the second lift plan [T, M] and the fourth lift plan [T, M] of the first pile thread (3) are replaced by respective correction lift plans [M, T], and the second lift plan [B, T] and the fourth lift plan [B, T] of the second pile thread (4) are replaced by respective correction lift plans [T, B].

With the weave correction according to FIG. 13B the four successive lift plans [B, T], [T, M], [B, T], [T, M] of the first pile thread (3) are replaced by the following four successive lift plans: [B, M], [M, T], [B, M], [M, T], and the four successive lift plans [M, B], [B, T], [M, B], [B, T] of the second pile thread (4) are replaced by the following four successive lift plans. [M, T], [B, M], [M, T], [B, M].

3. If both the first pile thread (3) and the second pile thread (4) are inwoven in the bottom backing fabric, these pile threads have the following successive lift plans:
   the first pile thread (3): [B, T], [M, B], [B, T], [M, B]
   the second pile thread (4): [M, B], [B, T], [M, B], [B, T]

Figure 10A:
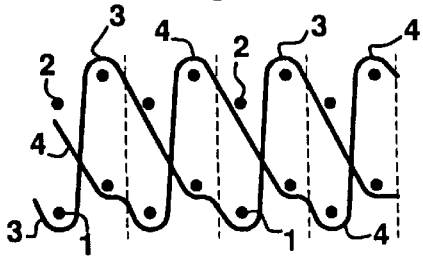
Figure 14A:
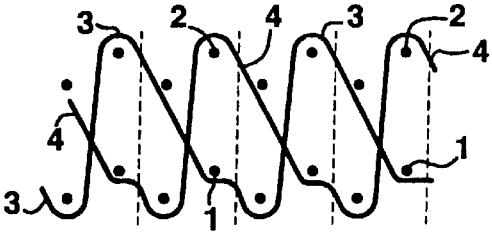

This situation is represented in FIGS. 10A and 14A. Double-acting pile tufts are obtained between the third (1) and the fourth weft thread (1) and between the seventh (1) and the eighth weft thread (1) of the bottom backing fabric.

Figure 10B:
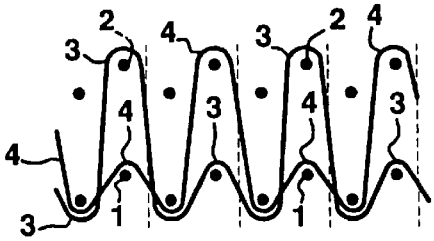
Figure 14B:
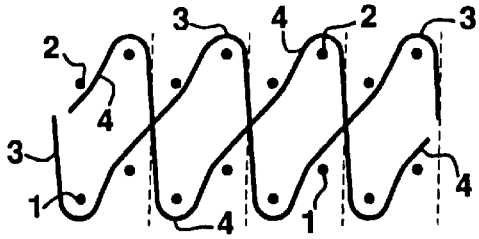

The adverse effects which could occur in this situation can be avoided in two different ways, respectively by a weave correction according to FIG. 10B and by a weave correction according to FIG. 14B.

With the weave correction according to FIG. 10B the second lift plan [M, B] and the fourth lift plan [M, B] of the first pile thread (3) and the first lift plan [M, B] and the third lift plan [M, B] of the second pile thread (4) are replaced by respective correction lift plans [B, M].

With the weave correction according to FIG. 14B the four successive lift plans [B, T], [M, B], [B, T], [M, B] of the first pile thread (3) are replaced by the following four successive lift plans: [B, M], [M, T], [B, M], [M, T], and the four successive lift plans [M, B], [B, T], [M, B], [B, T] of the second pile thread (4) are replaced by the following four successive lift plans: [M, T], [B, M], [M, T], [B, M].

Figure 11A:
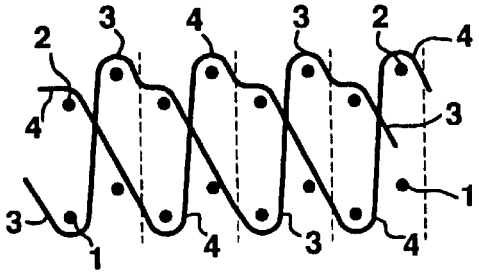
Figure 15A:
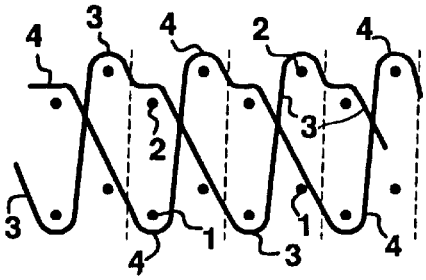

4. If both the first pile thread (3) and the second pile thread (4) are inwoven in the top backing fabric, these pile threads have the following successive lift plans:
   the first pile thread (3) [B, T], [T, M] , [B, T], [T, M]
   the second pile thread (4): [T, M], [B, T], [T, M], This situation is represented in FIGS. 11A and 15A. Double-acting pile tufts are obtained between the third (2) and the fourth weft thread (2) and between the seventh (2) and the eighth weft thread (2) of the top backing fabric.

Figure 11B:
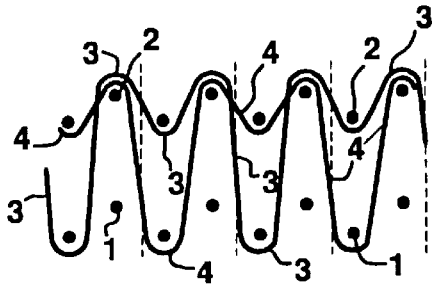
Figure 15B:
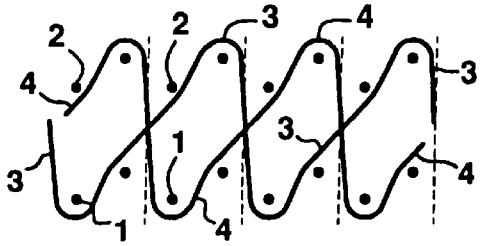

The adverse effects which could occur in this situation can be avoided in two different ways, respectively by a weave correction according to FIG. 11B and by a weave correction according to FIG. 15B.

With the weave correction according to FIG. 11B the second lift plan [T, M] and the fourth lift plan [T, M] of the first pile thread (3) and the first lift plan [T, M] and the third lift plan [T, M] of the second pile thread (4) are replaced by respective correction lift plans [M, T], With the weave correction according to FIG. 15B the four successive lift plans [B, T], [T, M], [B, T], [T, M] of the first pile thread (3) are replaced by the following four successive lift plans; [B, M], [M, T], [B, M], [M, T], and the four successive lift plans [T, M], [B, T], [T, M], [B, T] of the second pile thread (4) are replaced by the following four successive lift plans: [M, T], [B, M], [M, T], [B, M].

According to this invention the color transitions which could produce the above mentioned adverse effects are detected in the card design of the pile fabric with a computer programmed for that purpose.

The necessary corrections (=the necessary replacements of lift plans by correction lift plans) in order to avoid these effects are subsequently also automatically performed by the computer. The corrections performed are stored in a computer file. This file is used during weaving as a series of control data for the jacquard machine.

What is claimed is:

1. A method for face-to-face weaving of a pile fabric on a weaving machine in successive insertion cycles comprising inserting in each cycle two weft threads generally simultaneously between binding warp threads and pile threads of the machine thereby weaving two backing fabrics, providing parts of the pile threads for forming pile according to a two-shot weave and providing other parts which are inwoven in a backing fabric, wherein two pile threads perform a pile change and successive positions (B=bottom; M=middle; T=top) of each pile thread are predetermined in relation to the weft threads in a series of successive lift plans, of which every lift plan determines the positions in relation to the weft threads of two successive insertion cycles, wherein a lift plan preceding or succeeding a pile change of at least one of the pile threads performing the pile change is replaced by a correction lift plan for preventing a pile change effect in the pile thread forming the pile prior to the pile change and after the pile change is inwoven in the bottom backing fabric, replacing either the last lift plan (B, T) prior to the pile change by a correction lift plan (T, B), or replacing the first lift plan (M, B) after the pile change by a correction lift plan (B, M) of the pile thread forming the pile prior to the pile change and after the pile change inwoven in the top backing fabric, replacing either the last lift plan (B, T) prior to the pile change by a correction lift plan (T, B), or replacing the first lift plan (T, M) after the pile change by a correction lift plan (M, T) or a correction lift plan (M, M) of the pile thread forming pile after the pile change and prior to the pile change inwoven in the bottom backing fabric, either the last lift plan (M, B) is replaced prior to the pile change by a correction lift plan (B, M), or by a correction lift plan (M, M), or the first lift plan (B, T) is replaced after the pile change by a correction lift plan (T, B), and that of the pile thread forming pile after the pile change and prior to the pile change inwoven in the top backing fabric, either the last lift plan (T, M) is replaced prior to the pile change by a correction lift plan (M, T), or the first lift plan (B, T) is replaced after the pile change by a correction lift plan (T, B), or by a correction lift plan (M, T).

2. The method of claim 1, wherein a first and a second pile thread perform two pile changes one after another by a respective series of three successive lift plans, wherein the first pile thread forms pile according to the first and the third lift plan of the series and is inwoven by a second lift plan, and wherein the second pile thread forms pile according to the second lift plan of the series and is inwoven according to the first and the third lift plan, wherein the first and the second pile thread are inwoven respectively in the bottom and the top backing fabric, wherein the second lift plan (M, B) of the first pile thread is replaced by a correction lift plan (B, M) and the second lift plan (B, T) of the second pile thread is replaced by a correction lift plan (T, B), wherein the first and the second pile thread are inwoven respectively in the top and the bottom backing fabric, wherein when the second lift plan (T, M) of the first pile thread is replaced by a correction lift plan (M, T) the second lift plan (B, T) of the second pile thread is replaced by a correction lift plan (T, B), wherein when the first and the second pile thread are inwoven in the bottom backing fabric, the second lift plan (M, B) of the first pile thread and the first lift plan (M, B) of the second pile thread are replaced by a correction lift plan (B, M), and wherein when the first and the second pile thread are inwoven in the top backing fabric, the second lift plan (T, M) of the first pile thread and the first lift plan (T, M) of the second pile thread are replaced by a correction lift plan (M, T).

3. The method of claim 1, wherein when the pile thread forming the pile prior to a pile change and inwoven in the bottom backing fabric after the pile change the first lift plan (M, B) after the pile change is replaced after the pile change by a correction lift plan (B, M), and that of the pile thread inwoven in the top backing fabric prior to the pile change and forming pile according to at least two successive lift plans after the pile change, the first lift plan (B, T) after the pile change is replaced by a correction lift plan (M, T).

4. The method of claim 1, further comprising each of a first, a second and a third pile thread performing two successive pile changes in a respective series of three successive lift plans, wherein the first pile thread forms the pile according to the first lift plan of the series and inwoven according to the second and the third lift plan, wherein the second pile thread forms pile according to the second lift plan of its series and inwoven according to its first and its third lift plan, and wherein the third pile thread forms pile according to the third lift plan of its series, and inwoven according to its first and its second lift plan, wherein when the first and the third pile threads have to be inwoven in the bottom backing fabric, and the second pile thread has to be inwoven in the top backing fabric the second lift plan (M, B) of the first pile thread is replaced by a correction lift plan (B, M), the second lift plan (B, T) of the second pile thread is replaced by a correction lift plan (T, B), and the second lift plan (M, B) of the third pile thread is replaced by a correction lift plan (M, M)

wherein when the first pile thread has to be inwoven in the bottom backing fabric, and the second and the third pile thread have to be inwoven in the top backing fabric, the second lift plan (M, B) of the first pile thread is replaced by a correction lift plan (B, M), the second lift plan (B, T) of the second pile thread is replaced by a correction lift plan (T, B), and the third lift plan (B, T) of the third pile thread is replaced by a correction lift plan (T, B).

5. A method for face-to-face weaving of a pile fabric on a weaving machine in successive insertion cycles comprising inserting in each cycle two weft threads generally simultaneously between binding warp threads and pile threads of the machine for weaving two backing fabrics, providing parts of the pile threads for forming pile according to a two-shot weave and providing other parts of the pile threads which are inwoven in a backing fabric, two pile threads performing a pile change, whereby the successive positions (B=bottom; M=middle; T=top) of each pile thread is predetermined in relation to the weft threads in a series of successive lift plans of which every lift plan determines positions of two successive insertion cycles in relation to the weft threads wherein a lift plan preceding and/or succeeding the pile change of at least one of the pile threads performing the pile change are replaced by a correction lift plan for preventing a pile change effect, wherein when the pile thread forms pile prior to a pile change and is inwoven after the pile change the last lift plan (B, T) prior to the pile change and the first lift plan (M, B) or (T, M) after the pile change are respectively replaced by successive correction lift plans (B, M) and (M, T), and wherein when the pile thread has to be inwoven prior to the pile change and has to form pile after the pile change, the last lift plan (M, B) or (T, M) prior to the pile change and the first lift plan (B, T) after the pile change are respectively replaced by successive correction lift plans (M, T) and (B, M).

6. The method of claim 5, wherein the two pile threads perform a pile change after every two successive insertion cycles according to a respective series of successive lift plans, wherein all lift plans (B, T) of a series are replaced by lift plans (B, M), and wherein all lift plans (M, B) and (T, M) of the series are replaced by lift plans (M, T).

7. The method of claim 5, wherein every replacement of a lift plan by a correction lift plan is automatically performed by a device programmed for that purpose.

8. The method of claim 7, wherein the device automatically detects pile changes to be avoided based on a card design of the pile fabric to be woven.

* * * * *